US010195891B2

(12) United States Patent
Cote

(10) Patent No.: US 10,195,891 B2
(45) Date of Patent: Feb. 5, 2019

(54) METHOD FOR PRODUCING A COMPOSITE WEB AND SECURITY DEVICES PREPARED FROM THE COMPOSITE WEB

(71) Applicant: Crane Security Technologies, Inc., Nashua, NH (US)

(72) Inventor: Paul F. Cote, Hollis, NH (US)

(73) Assignee: Crane Security Technologies, Inc., Nashua, NH (US)

( * ) Notice: Subject to any disclaimer, the term of this patent is extended or adjusted under 35 U.S.C. 154(b) by 521 days.

(21) Appl. No.: 14/347,476

(22) PCT Filed: Sep. 20, 2012

(86) PCT No.: PCT/US2012/056350
§ 371 (c)(1),
(2) Date: Mar. 26, 2014

(87) PCT Pub. No.: WO2013/048875
PCT Pub. Date: Apr. 4, 2013

(65) Prior Publication Data

US 2014/0300096 A1 Oct. 9, 2014

Related U.S. Application Data

(60) Provisional application No. 61/539,149, filed on Sep. 26, 2011.

(51) Int. Cl.
*B42D 25/355* (2014.01)
*B42D 25/328* (2014.01)
(Continued)

(52) U.S. Cl.
CPC ..... *B42D 25/355* (2014.10); *B42D 25/00* (2014.10); *B42D 25/328* (2014.10);
(Continued)

(58) Field of Classification Search
CPC ..... B42D 25/355
See application file for complete search history.

(56) References Cited

U.S. PATENT DOCUMENTS 5,068,008 A * 11/1991 Crane ..... B42D 25/355 216/49
5,567,276 A 10/1996 Boehm et al.
(Continued)

FOREIGN PATENT DOCUMENTS

CH 689680 8/1999
DE 102007040865 11/2008
(Continued)

*Primary Examiner* — Kyle R Grabowski

(57) ABSTRACT

A composite security device is provided that is made up of a first polymer film that constitutes or embodies a security feature in the form of at least one high value material, and a second polymer film that constitutes, embodies, or is coated with one or more additional security features. The first polymer film is positioned on and adhered to a surface of the second polymer film, which has a width or diameter greater than the width or diameter of the first polymer film By way of the present invention, the high value material is applied to only a part of the security device, leaving remaining parts of the device available for one or more additional materials that do not impact upon the effect of the high value material.

14 Claims, 4 Drawing Sheets

(51) Int. Cl.

| | |
|---|---|
| ***B42D 25/00*** | (2014.01) |
| *B42D 25/45* | (2014.01) |
| *B42D 25/382* | (2014.01) |
| *B42D 25/47* | (2014.01) |
| *B42D 25/475* | (2014.01) |
| *B42D 25/387* | (2014.01) |

(52) U.S. Cl.
CPC ..... *B42D 25/382* (2014.10); *B42D 25/387* (2014.10); *B42D 25/45* (2014.10); *B42D 25/47* (2014.10); *B42D 25/475* (2014.10); *B42D 2033/08* (2013.01); *B42D 2033/10* (2013.01); *B42D 2033/16* (2013.01); *B42D 2033/20* (2013.01); *B42D 2033/26* (2013.01); *B42D 2033/30* (2013.01); *B42D 2035/20* (2013.01); *Y10T 156/1067* (2015.01)

(56) References Cited

U.S. PATENT DOCUMENTS

| | | | | |
|---|---|---|---|---|
| 5,631,039 | A | 5/1997 | Knight et al. | |
| 5,688,587 | A * | 11/1997 | Burchard | B42D 25/355 283/70 |
| 6,299,213 | B1 | 10/2001 | Souparis | |
| 7,279,234 | B2 * | 10/2007 | Dean | C09K 11/025 252/301.16 |
| 7,333,268 | B2 | 2/2008 | Steenblik et al. | |
| 7,468,842 | B2 | 12/2008 | Steenblik et al. | |
| 7,738,175 | B2 | 6/2010 | Steenblik et al. | |
| 7,830,627 | B2 | 11/2010 | Commander et al. | |
| 8,149,511 | B2 | 4/2012 | Kaule et al. | |
| 8,400,495 | B2 | 3/2013 | Kaule | |
| 8,573,651 | B2 * | 11/2013 | Seki | B42D 25/351 283/57 |
| 8,632,100 | B2 | 1/2014 | Kaule et al. | |
| 2002/0160194 | A1 * | 10/2002 | Phillips | B42D 25/29 428/404 |
| 2005/0040641 | A1 * | 2/2005 | Cote | B42D 25/355 283/72 |
| 2005/0042449 | A1 * | 2/2005 | Phillips | B42D 25/355 428/378 |
| 2005/0104364 | A1 * | 5/2005 | Keller | B42D 25/29 283/72 |
| 2005/0151368 | A1 | 7/2005 | Heim | |
| 2008/0035736 | A1 | 2/2008 | Tompkin et al. | |
| 2008/0079257 | A1 * | 4/2008 | Fessl | B42D 25/355 283/72 |
| 2008/0250954 | A1 * | 10/2008 | Depta | B42D 25/41 283/67 |
| 2010/0001509 | A1 * | 1/2010 | Whiteman | B42D 25/355 283/91 |
| 2010/0177094 | A1 | 7/2010 | Kaule et al. | |
| 2010/0182221 | A1 | 7/2010 | Kaule et al. | |
| 2011/0019283 | A1 * | 1/2011 | Steenblik | B42D 25/29 283/72 |
| 2011/0095518 | A1 * | 4/2011 | Hoffmuller | B42D 25/373 283/85 |
| 2012/0074684 | A1 * | 3/2012 | Marchant | B42D 25/00 283/85 |
| 2012/0193905 | A1 | 8/2012 | Schilling et al. | |

FOREIGN PATENT DOCUMENTS

| | | | | |
|---|---|---|---|---|
| EP | 0238043 | A2 * | 9/1987 | B29C 59/04 |
| EP | 1273705 | | 1/2003 | |
| EP | 2147156 | | 1/2010 | |
| EP | 2164713 | | 3/2010 | |
| EP | 2162294 | B1 | 3/2012 | |
| GB | 2283203 | A | 5/1995 | |
| JP | 2001-315472 | | 11/2001 | |
| WO | WO 97/019820 | | 6/1997 | |
| WO | WO 97/023856 | | 7/1997 | |
| WO | WO 98/33648 | | 8/1998 | |
| WO | WO 2002/000445 | | 1/2002 | |
| WO | WO 2003/082598 | | 10/2003 | |
| WO | WO 2005/069231 | | 7/2005 | |
| WO | WO 2005/106601 | | 11/2005 | |
| WO | WO 2006/029857 | | 3/2006 | |
| WO | WO 2008/135174 | | 11/2008 | |
| WO | WO 2009/151607 | A1 | 12/2009 | |
| WO | WO 2011/029602 | | 3/2011 | |
| WO | WO 2011/069631 | | 6/2011 | |
| WO | WO 2011/107527 | | 9/2011 | |

* cited by examiner

METHOD FOR PRODUCING A COMPOSITE WEB AND SECURITY DEVICES PREPARED FROM THE COMPOSITE WEB

RELATED APPLICATION

This application claims priority to U.S. Provisional Patent Application Ser. No. 61/539,149, filed Sep. 26, 2011, which is incorporated herein in its entirety by reference.

TECHNICAL FIELD

The present invention generally relates to a method for producing composite webs and to security devices prepared from such composite webs.

BACKGROUND AND SUMMARY OF THE INVENTION

Security devices (e.g., security threads, strips and patches) are used widely in security documents such as banknotes, passports and other high value documents. Typically, they are incorporated into the security document during manufacture although in some cases they are adhered onto a surface of the document after manufacture of the document itself.

Efforts to increase the security of these devices have included the use of high value materials such as liquid crystal color shift materials, which are inherently complex and specialized. These high value materials are typically applied as a film or thin layer on a surface of a continuous polymeric web substrate during continuous web manufacturing processes. Many times, however, the high value material is hidden or obscured in areas on the web surface by the application of additional materials (e.g., printed information).

The present inventor has developed a method for reducing the amount of high value materials used in the manufacture of security devices, and thus the cost of manufacture, while avoiding degradation or obscuration of the high value material. By way of the inventive method, the high value material is applied to only a part of the security device, leaving remaining parts of the device available for one or more additional materials that do not impact upon the effect of the high value material. In an exemplary embodiment, the inventive method allows for a 50% reduction in the amount of high value materials used in the manufacture of these security devices.

The term "high value materials", as used herein, is intended to mean special materials typically in the form of films (or film-like materials) that have a high value due to their inherent specialization and complexity. Examples of such high value materials include, but are not limited to, liquid crystal color shift films, dielectric layer color shift films, diffraction grating films, holographic films, micro-optic film materials that project synthetic images, and the like.

The present invention specifically provides a method for producing a composite web for making composite security devices, the method comprising:

(a) providing a first polymer film in the form of a first continuous web, wherein the first polymer film constitutes or embodies one or more first security features in the form of at least one high value material;

(b) providing a second polymer film in the form of a second continuous web, wherein the second polymer film constitutes, embodies, or is coated with one or more second security features;

(c) optionally applying one or more additional security features and/or one or more adhesives to one or opposing surfaces of the first and second continuous webs;

(d) in-line slitting the first continuous web into a number of relatively narrow width high value threads or strips;

(e) introducing separation between these relatively narrow width high value threads or strips;

(f) positioning and attaching the separated high value threads or strips to a surface of the second continuous web to form a continuous composite web; and optionally, (g) laminating one or more protective layers to one or opposing surfaces of the continuous composite web.

The resulting continuous composite web may then be slit into a number of composite security threads or strips, with each composite thread or strip having one of the narrow width high value threads or strips adhered to a surface thereof, the high value thread or strip positioned between, or aligned with one of the composite thread's or strip's longitudinal borders or edges.

The present invention further provides a composite security device, as described above.

Also provided are sheet materials that are made from or employ the inventive composite security device, as well as documents made from these materials. The term "documents", as used herein designates documents of any kind having financial value, such as banknotes or currency, and the like, or identity documents, such as passports, ID cards, driving licenses, and the like, or non-secure documents, such as labels. The inventive optical system is also contemplated for use with consumer goods as well as bags or packaging used with consumer goods.

Other features and advantages of the invention will be apparent to one of ordinary skill from the following detailed description and accompanying drawings. Unless otherwise defined, all technical and scientific terms used herein have the same meaning as commonly understood by one of ordinary skill in the art to which this invention belongs. All publications, patent applications, patents and other references mentioned herein are incorporated by reference in their entirety. In case of conflict, the present specification, including definitions, will control. In addition, the materials, methods, and examples are illustrative only and not intended to be limiting.

BRIEF DESCRIPTION OF THE DRAWINGS

The present disclosure may be better understood with reference to the following drawings. Matching reference numerals designate corresponding parts throughout the drawings, and components in the drawings are not necessarily to scale, emphasis instead being placed upon clearly illustrating the principles of the present disclosure. While exemplary embodiments are disclosed in connection with the drawings, there is no intent to limit the present disclosure to the embodiment or embodiments disclosed herein. On the contrary, the intent is to cover all alternatives, modifications and equivalents.

Particular features of the disclosed invention are illustrated by reference to the accompanying drawings in which:

FIGS. 8 and 9 are enlarged views relative to the size of the other views in order to provide details of the micro-optic film material.

DETAILED DESCRIPTION OF THE INVENTION

Figure 1:
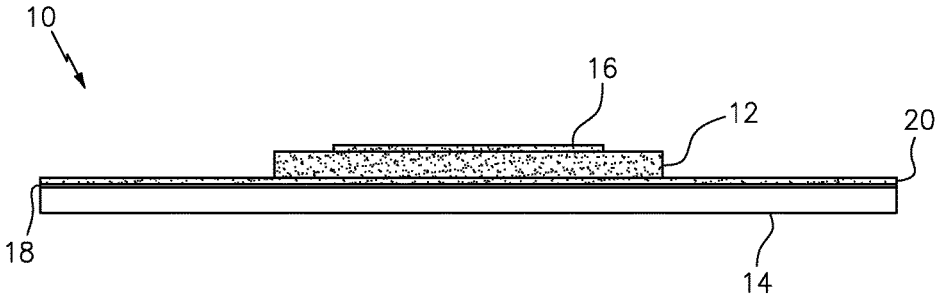
FIG. 1 is a cross-sectional side view of an exemplary embodiment of the composite security device of the present invention in the form of a security thread or strip.

The composite security device of the present invention makes use of a reduced amount of high value materials while avoiding any impact (e.g., degradation, obscuration) by other security features on the effect demonstrated by these high value materials.

It is noted that while the composite security device of the present invention is described herein mainly as a security thread or strip, it is not so limited. As will be readily appreciated by those skilled in the art, the method for producing the inventive composite security device can be modified to accommodate different sizes, shapes, and configurations (patterns, designs, arrangements) of these composite devices. For example, a small strip of high value film or film-like material (e.g., a 2 millimeter (mm) wide strip) could be applied to a much larger stripe (e.g., a 10 mm wide stripe). A patch (e.g., a 25 mm×25 mm square patch) could likewise include a high value strip somewhere within its boundaries. The edge boundaries of the high value strip as well as the stripe and patch are not limited to straight edges. These edges could incorporate specific curved designs to add to the complexity of the inventive composite security device.

As described above, the composite security device of the present invention basically comprises:

(a) a first polymer film that constitutes or embodies one or more first security features in the form of at least one high value material, the first polymer film having a width or diameter; and (b) a second polymer film that constitutes, embodies, or is coated with one or more second security features, the second polymer film having a width or diameter greater than the width or diameter of the first polymer film, wherein the first polymer film is positioned on and adhered to a surface of the second polymer film.

The first polymer film may be positioned on either a top or bottom surface of the second polymer film. When adhered to the bottom surface, the second polymer film may have one or more regions which provide visual access (e.g., transparent regions) to the underlying first polymer film, with the design of these regions adding to the level of security demonstrated by the inventive composite security device.

The first polymer film (FPF) constitutes or embodies at least one high value material. Such a so-called "high value" polymer film, in one exemplary embodiment, constitutes a thin-layer element with color shift effect. Such thin-layer elements are made up of one or more thin layers having at least one region that exhibits a color shift effect. The region(s) exhibits a spectral shift and hence a visual color shift that varies with the viewing angle. The amount of color shift is dependent on the materials used to form the layer(s) and the thickness of the layer(s). Moreover, color shift components may, at certain wavelengths, exhibit the property of higher reflectance with increased viewing angle.

The thin-layer element may be at least partially coated with, imprinted or embossed, or formed from a color shifting pigment (e.g., liquid crystal flakes), ink (e.g., liquid crystal color shifting ink), foil, or bulk material, and in an exemplary embodiment, is a color shift film (CSF).

Color shifting inks are available from SICPA Securink Corporation, SICPA Product Security LLC, 8000 Research Way, Springfield, Va. 22153, while liquid crystal materials are available from BASF Corporation North America, 100 Campus Drive, Florham Park, N.J. 07932.

CSFs are available from JDS Uniphase Corporation, 430 North McCarthy Boulevard, Milpitas, Calif. 95035 ("JDS Uniphase Corp."), under the trade designation Color Shift Film, and from Giesecke & Devrient GmbH, Prinzregentenstrasse 159, D-81677, Munich, Germany under the trade designation Color A/Color B Color Shift Foil.

In another exemplary embodiment, the "high value" polymer film is a micro-optic film material that projects synthetic images. These materials generally comprise (a) a light-transmitting polymeric substrate, (b) an arrangement of micro-sized image icons located on or within the polymeric substrate, and (c) an arrangement of focusing elements (e.g., microlenses). The image icon and focusing element arrangements are configured such that when the arrangement of image icons is viewed through the arrangement of focusing elements, one or more synthetic images are projected. These projected images may show a number of different optical effects. Material constructions capable of presenting such effects are described in U.S. Pat. No. 7,333,268 to Steenblik et al., U.S. Pat. No. 7,468,842 to Steenblik et al., U.S. Pat. No. 7,738,175 to Steenblik et al., U.S. Pat. No. 7,830,627 to Commander et al., U.S. Pat. No. 8,149,511 to Kaule et al.; U.S. Patent Application Publication No. 2010/0177094 to Kaule et al.; U.S. Patent Application Publication No. 2010/0182221 to Kaule et al.; European Patent No. EP 2 162 294 B1 to Kaule et al.; and European Patent Application No. 08759342.2 (or European Publication No. 2164713) to Kaule.

In a further embodiment, the "high value" polymer film is a holographic film material, which is available from JDS Uniphase Corp.

One or more additional security features, which like the second security feature(s) may be of the same or lesser value than the "high value" material(s), may also be applied to one or more layers or surfaces of the FPF. By way of example, metal and/or magnetic graphic indicia in the form of letters, numbers, symbols, or bar codes may be printed on one or opposing surfaces of the FPF. When printed on the back side of the FPF, these indicia become covert indicia that are hidden from view in the fully assembled composite security device. By way of further example, pigments that are white in visible light and that emit a color other than white under ultraviolet (UV) illumination may be incorporated in one or more layers or surfaces of the FPF.

In addition, an adhesive (e.g., a thermally activated adhesive) may be applied to a surface of the FPF to facilitate bonding to the SPF.

Preferred widths or diameters of the FPF range from about 1 to about 5 mm (more preferred, from about 2 mm to about 3 mm), while preferred thicknesses range from about 8 to about 20 microns (more preferred, from about 10 to about 12 microns).

The SPF, which is positioned above or below the FPF in the inventive composite security device, may constitute or embody one or more overt and/or covert second security features, or may have these second security features applied as a coating to one or opposing surfaces. As mentioned above, the SPF has a width or diameter greater than the width or diameter of the FPF.

As previously noted, the second security feature(s) may be of the same or lesser value than the "high value" material(s). As will be readily appreciated by those skilled in the art, sometimes it may be desirable to combine two expensive materials which cannot be manufactured at the same time onto a single device. For example, it may be desirable for the FPF and the SPF to both constitute CSFs, with each CSF exhibiting a different color shift spectrum. It may also be desirable for the FPF to constitute a micro-optic film material, and for the SPF to constitute a film coated with an optically variable material (e.g., a polymeric liquid crystal). It may also be desirable for the FPF and/or the SPF to employ two or more "high value" materials such as a CSF with optically variable regions.

The SPF, in one exemplary embodiment, constitutes or embodies one or more second security features having a value less than the value of the "high value" material(s). One such example is a film material embodying UV illuminated pigments or dyes, infrared (IR) absorbing/reflecting materials, or the like.

The SPF, in another exemplary embodiment, constitutes or embodies one or more second security features having a value similar to the value of the "high value" material(s). For example, the SPF may constitute a CSF optionally with optically variable regions, as noted above, or it may constitute a diffraction grating film, a holographic film, or the like.

Preferred thicknesses for the SPF in these embodiments range from about 8 to about 12 microns, while more preferred thicknesses range from about 9 to about 11 microns.

The SPF may also be coated with one or more second security features in the form of materials having a value less than or similar to the "high value" material(s). In such embodiments, the SPF serves as a "carrier" film that may be formed using (a) one or more essentially colorless materials including, but not limited to, polymers such as polycarbonate, polyester, polyethylene, polyethylene napthalate, polyethylene terephthalate, polypropylene, polyvinylidene chloride, and the like, or (b) one or more colored or opaque materials (e.g., white films such as those prepared by adding titanium dioxide ($TiO_2$) to one or more of the above listed polymers).

Contemplated materials, which are suitable for coating or depositing onto one or opposing surfaces of the SPF "carrier" film, include, but are not limited to, metal or metallic materials such as aluminum indicia (e.g., aluminum indicia made using a resist and etch technique, which may optionally utilize a transparent pigment in a resist layer that matches one of the colors in an overlying CSF), magnetic materials, liquid crystal pigments, UV illuminated pigments or dyes and/or IR absorbing/reflecting materials (e.g., fluorescent pigments in bar patterns), and the like.

As will be readily appreciated by those skilled in the art, when second security features are applied to a surface of the SPF in those areas that will be occupied by the FPF (i.e., the slit FPF sub-webs), these features become covert features that are hidden from view in the fully assembled composite security device.

Preferred thicknesses for the SPF "carrier" film range from about 7 to about 12 microns, while more preferred thicknesses range from about 8 to about 10 microns. The materials are coated onto the SPF "carrier" film at thicknesses ranging from about 1 to about 5 microns (preferably, from about 2 to about 3 microns).

In addition, and as noted for the FPF, an adhesive (e.g., a thermally activated adhesive) may also be applied to a surface of the SPF to facilitate bonding to the FPF.

The preferred width or diameter of the SPF ranges from about 4 to about 25 mm, more preferably, from about 5 to about 8 mm.

Other layers contemplated for use with the composite security device of the present invention include sealing or obscuring layers, outer protective layers, and adhesive layers that facilitate incorporation of the inventive composite device into or onto secure or non-secure documents.

The method for preparing the inventive composite security devices in the form of security threads or strips comprises:

(a) providing a FPF in the form of a first continuous web, wherein the FPF constitutes or embodies one or more first security features in the form of at least one high value material;
(b) providing a SPF in the form of a second continuous web, wherein the SPF constitutes, embodies, or is coated with one or more second security features;
(c) optionally applying one or more additional security features and/or one or more adhesives to one or opposing surfaces of the first and second continuous webs;
(d) in-line slitting the first continuous web into a number of relatively narrow width high value threads or strips;
(e) introducing separation between these relatively narrow width high value threads or strips;
(f) positioning and attaching the separated high value threads or strips to a surface of the second continuous web to form a continuous composite web; optionally,
(g) laminating a protective layer to one or opposing surfaces of the continuous composite web; and
(h) slitting the continuous composite web into a number of composite security threads or strips.

In one exemplary embodiment of the inventive method, a web of CSF is printed with text or other indicia and then slit, in line, into 3 mm wide threads. The slit threads are then positioned at a distance apart of 6 mm on a second metalized web that has optionally been demetalized using a tinted resist to match one of the color shift range of colors. In addition, magnetic bar code is optionally incorporated between each slit thread and the second metalized web. An obscuring layer (e.g., camouflage white ($TiO_2$ or other light scattering material) layer) is optionally applied to the back side of the second metalized web with fluorescent pigments in bar patterns. The entire construction is then over-laminated with a clear polymer layer for protection. The composite web is then slit to a width of 6 mm and spooled.

Figure 2:
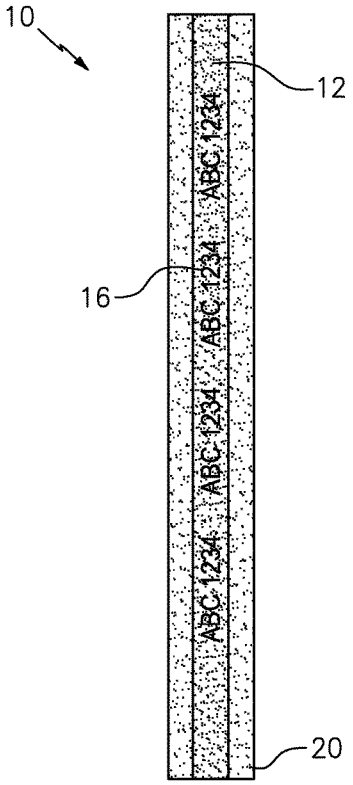
FIG. 2 is a top planar view of the exemplary embodiment of the inventive composite security device shown in FIG. 1.

Referring now to FIG. 1 and FIG. 2, another exemplary embodiment of the composite security thread of the present invention is shown generally at 10. The inventive thread 10 basically comprises a FPF 12 and a SPF 14. The FPF 12 is a CSF that has black text (ABC 1234) 16 applied to an upper surface. The SPF 14 is a film that has a metal layer 18 and a pigmented resist layer 20 applied to its upper surface, the color of the pigmented resist layer 20 matching one of the CSF's range of colors.

Figure 5:
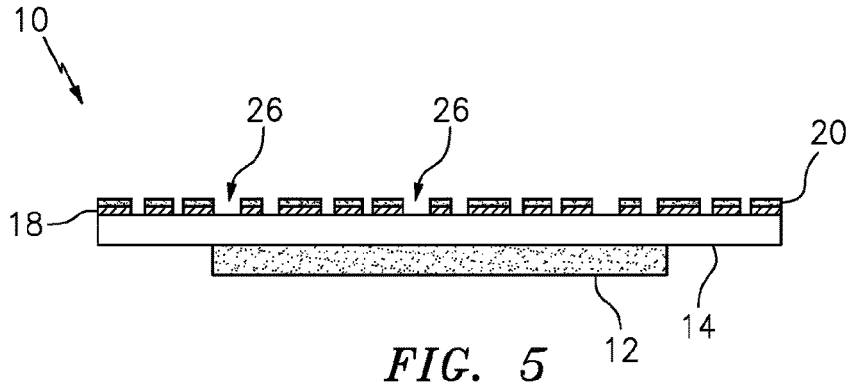
FIG. 5, FIG. 6, FIG. 7, FIG. 8, FIG. 9, and FIG. 10 are each cross-sectional side views of other exemplary embodiments of the composite security device of the preset invention, which are all in the form of a security thread or strip.

In FIG. 5, another exemplary embodiment of the inventive composite security thread 10 is shown. The inventive thread 10 basically comprises a FPF 12, which is adhered to a bottom surface of a transparent SPF 14. The SPF 14 has a metal layer 18 and a pigment or tinted resist layer 20 applied to its upper surface. The metal layer 18 has been demetalized using the tinted resist, thereby forming regions 26 which provide visual access to the underlying FPF 12.

Figure 6:
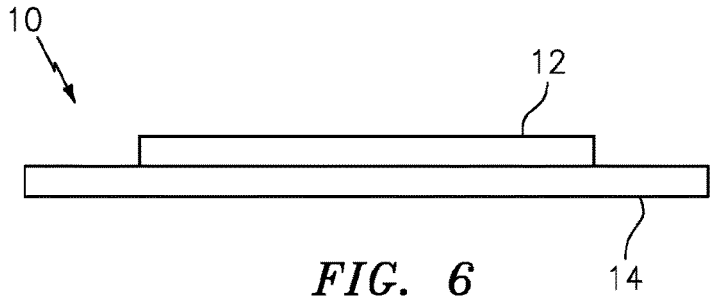

In FIG. 6, further exemplary embodiments of the inventive composite security thread 10 are shown. The inventive thread 10 basically comprises a FPF 12 and a SPF 14. The FPF 12 and the SPF 14 may constitute the following:

(1) FPF 12 and SPF 14 are color shift films, with each color shift film exhibiting a different color shift spectrum;

(2) FPF 12 is a micro-optic film material and SPF 14 is a film coated with an optically variable material:

(3) FPF 12 and SPF 14 are color shift films with optically variable regions;

(4) FPF 12 is a micro-optic film and SPF 14 is a diffraction grating film; or (5) FPF 12 is a color shift and SPF 14 is a holographic film.

Figure 7:
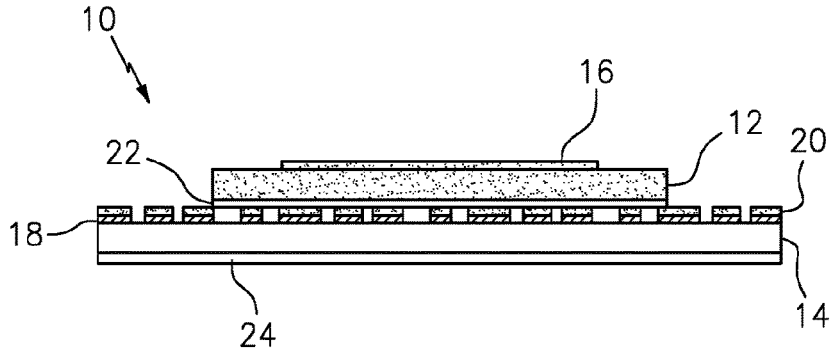

In FIG. 7, another exemplary embodiment of the inventive composite security thread 10 is shown. The inventive thread 10 basically comprises a FPF 12 and a SPF 14. The FPF 12 is a CSF that has black text (ABC 1234 (not shown)) 16 applied to an upper surface. The SPF 14 is a film that has a metal layer 18 and a pigmented or tinted resist layer 20 applied to its upper surface. The metal layer 18 has been demetalized using the tinted resist. The color of the pigmented resist layer 20 matches one of the CSF's range of colors, A magnetic bar code 22 is incorporated between FPF 12 and SPF 14. An obscuring layer 24 (e.g., camouflage white ($TiO_2$or other light scattering material) layer) is applied to the back side of SPF 14.

Figure 8:
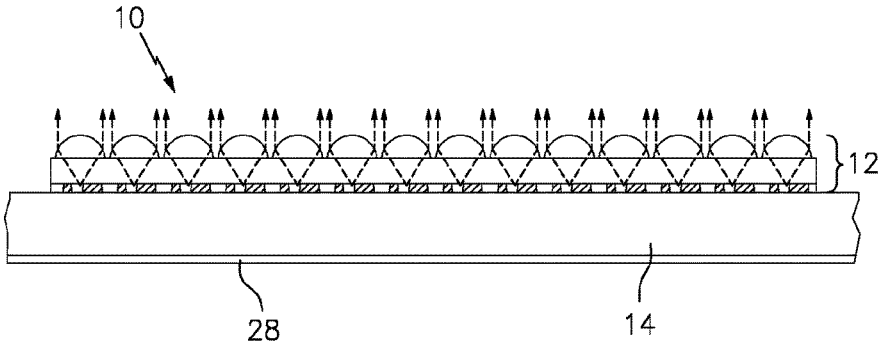

In FIG. 8, an embodiment of the inventive composite security thread 10 is shown in which the thread 10 comprises a FPF 12 and a SPF 14. The FPF 12 is a micro-optic film material and the SPF 14 is a film that is coated with an optically variable material 28.

Figure 9:
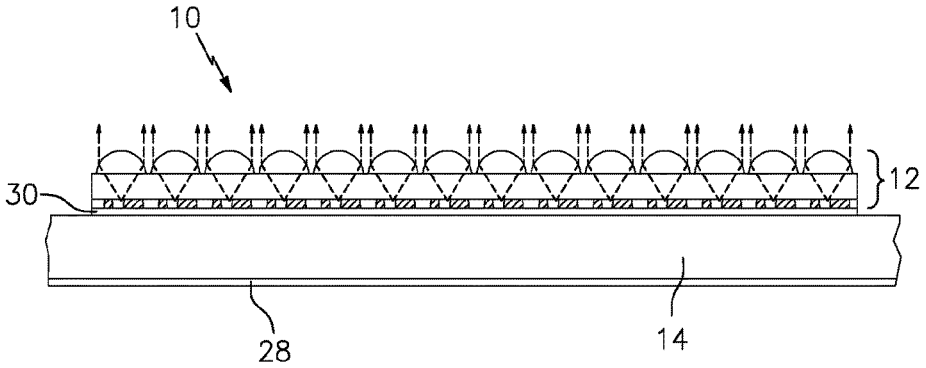

In FIG. 9, the composite security thread 10 of FIG. 8 is shown with printed covert graphic indicia 30 located between the FPF 12 and the SPF 14.

Figure 10:
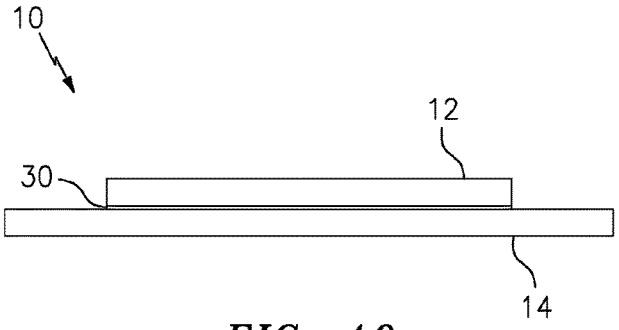

In FIG. 10, an embodiment of the inventive composite security thread 10 shown in which the thread 10 again comprises a FPF 12 and a SPF 14. The SPF 14 is a polymer film material having contained therein ultraviolet illuminated pigments or dyes, or infrared absorbing/reflecting materials. Printed covert graphic indicia 30 are located between the FPF 12 and the SPF 14.

The inventive composite security thread 10 may be prepared in a web/sheet-based continuous manufacturing process, which is implemented using a lamination nip, into which two webs (FPF or "Web A", SPF or "Web B") are simultaneously introduced and precisely guided one above the other.

Figure 3:
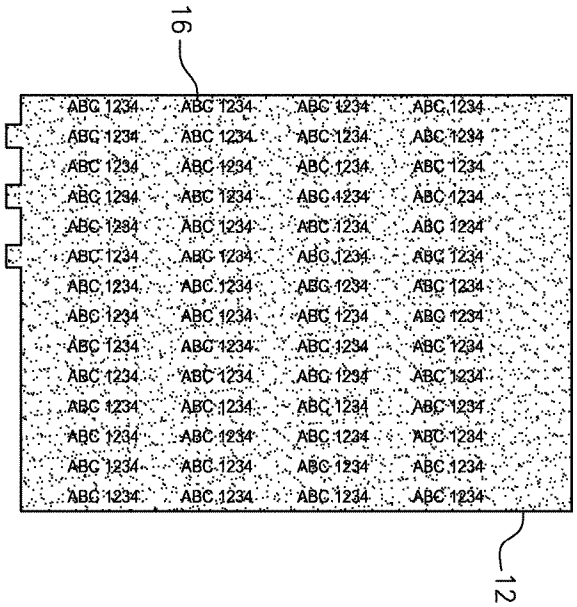
FIG. 3 is a top planar view of an exemplary embodiment of the first continuous web used in the practice of the present invention prior to slitting.

Generally speaking, and in an exemplary embodiment, a web constituting or embodying a "high value" material (Web A) is unwound and optionally one or more operations may then be performed on the web. For example, and as best shown in FIG. 3, printing in the form of repeating text may be applied in parallel columns across one or opposing surfaces of Web A and an adhesive (e.g., a thermally activatable adhesive) may simultaneously or subsequently be coated onto the back side of Web A to facilitate bonding to a web of the same or lesser value (Web B). In addition, Web A may be subjected to one or more converting operations (e.g., printing of magnetic bars on a back side, printing of UV illuminated pigments on a top side or back side).

Similarly, simultaneously introduced Web B, which is a web constituting or including a material of the same or lesser value than the "high value" material, is unwound and optionally one or more operations (as noted above) may then be performed on this web.

Upon completion of any operations on Web A, this web is precisely aligned to a tolerance ranging from about 0.1 to about 0.2 mm on an axis perpendicular to the machine or running direction of the converting machine and directed toward downstream slitting and lamination operations.

In particular, Web A is presented to a slitting machine (e.g., a Box Knife Shear slitting machine available from Independent Machine Company, 2 Stewart Place, Fairfield, N.J. 07004) employing a series of slitting knives (e.g., rotary knives, fixed blades), where it is divided into a plurality of sub-webs.

The sub-webs are then processed through a mechanical apparatus (e.g., a laminator available from Faustel, Inc., W194N11301 McCormick Drive, Germantown, Wis. 53022) that accepts the sub-webs in the same format as they emanate from the slitting machine. As the sub-webs pass through the mechanical apparatus, the mechanical apparatus is automatically adjusted from a compressed mode to an expanded mode which causes the sub-webs to slowly spread to positions roughly aligned with target positions on underlying Web B.

Figure 4:
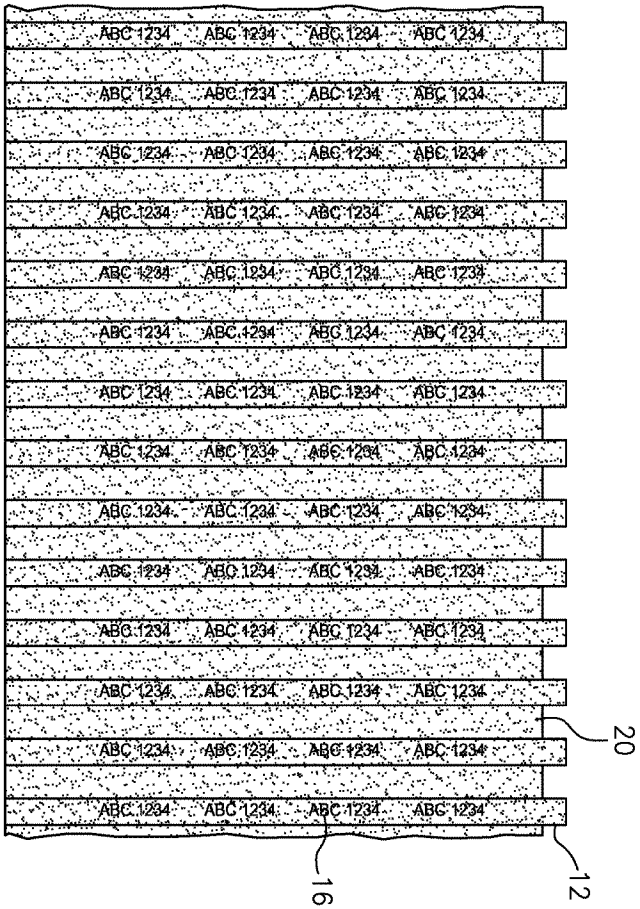
FIG. 4 is a top planar view of an exemplary embodiment of the continuous composite web used in the practice of the present invention prior to slitting.

The sub-webs are then optionally further adjusted to ensure full alignment with target positions on underlying Web B using, for example, a series of fixed eyelets or rollers or other apparatus that allows the sub-webs to be routed in a way that positions them at the final expanded width to align correctly with Web B (see FIG. 4).

Web B with aligned sub-webs is then directed through a laminating device such as a heated nip or other marrying device that presses or compiles the aligned sub-webs to Web B in a continuous fashion.

As will be readily appreciated by those skilled in the art, the webs are processed under controlled tension conditions, with web tension parameters being set to allow for any sub-webs of Web A which are too loose to become tighter and conversely any sub-webs of Web A which are too tight to become looser.

The composite web that exits the laminating device is then presented to another slitting machine where it is slit and then spooled. This may optionally be done in a separate operation.

The resulting composite threads or strips may be partially incorporated in fibrous sheet materials such as security papers during manufacture by techniques commonly employed in the papermaking industry. For example, the inventive composite security thread or strip may be embedded within a surface, or partially embedded within the body of a finished paper (i.e., windowed paper) by using, for example, a cylinder mold papermaking machine, cylinder vat machine, or similar machine of known type.

The composite thread or strip may also be mounted on a surface of a fibrous or non-fibrous sheet material either during or post manufacture. Mounting of the thread or strip may be achieved by any number of known techniques including: applying a pressure-sensitive adhesive to a surface of the thread or strip and pressing the thread or strip to the surface of the sheet material; and applying a heat activated adhesive to a surface of the thread or strip and applying the thread or strip, using thermal transfer techniques, to the surface of the material.

While various embodiments of the present invention have been described above, it should be understood that they have been presented by way of example only, and not limitation.

Thus, the breadth and scope of the present invention should not be limited by any of the exemplary embodiments.

I claim:

1. A composite security device that comprises:

(a) a first polymer film that constitutes or embodies one or more first security features in the form of at least one high value material, the first polymer film having a width or diameter; and (b) a second polymer film that constitutes, embodies, or is coated with one or more second security features, the second polymer film having a top and bottom surface and a width or diameter greater than the width or diameter of the first polymer film, wherein the first polymer film is positioned on and adhered to a surface of the second polymer film, wherein when an opaque material is coated on the top surface of the second polymer film and the first polymer film is adhered to the bottom surface of the second polymer film, the opaque material coating has one or more regions which provide visual access to the underlying first polymer film, and wherein the one or more second security features is also a high value material, wherein the first polymer film is a micro-optic film material located on a surface of the second polymer film, wherein the micro-optic film material includes an arrangement of micro-sized image icons, and the second polymer film is a film coated on an opposing surface with an optically variable material.

2. The composite security device of claim 1, wherein the optically variable material is selected from the group of: liquid crystal color shift films and dielectric layer color shift films.

3. The composite security device of claim 1, wherein metal and/or magnetic graphic indicia in the form of letters, numbers, symbols, or bar codes are printed on one or opposing surfaces of the first polymer film.

4. The composite security device of claim 3, wherein the graphic indicia are printed on a back side of the first polymer film, the graphic indicia constituting covert indicia that are hidden from view in the composite security device.

5. The composite security device of claim 1, wherein pigments that are white in visible light and that emit a color other than white under ultraviolet illumination are incorporated in one or more layers or surfaces of the first polymer film.

6. The composite security device of claim 1, wherein the second polymer film is coated with one or more colored or opaque materials, the one or more colored or opaque materials selected from the group of metal or metallic materials, magnetic materials, and liquid crystal pigments.

7. The composite security device of claim 1, wherein the first polymer film has a width or diameter ranging from about 1 to about 5 millimeters and a thickness ranging from about 8 to about 20 microns, wherein the second polymer film has a width or diameter ranging from about 4 to about 25 millimeters and a thickness ranging from about 8 to about 12 microns.

8. The composite security device of claim 1, wherein the first polymer film is a micro-optic film material that projects synthetic images.

9. A sheet material having opposing surfaces and comprising at least one composite security device of claim 1 that is either partially embedded within the sheet material, or mounted on, or embedded within, a surface of the sheet material.

10. A document prepared from the sheet material of claim 9.

11. A composite security device having (a) a first polymer film that constitutes or embodies one or more first security features in the form of at least one high value material, the first polymer film having a width or diameter: and (b) a second polymer film that constitutes, embodies, or is coated with one or more second security features, the second polymer film having a top and bottom surface and a width or diameter greater than the width or diameter of the first polymer film, wherein the first polymer film is positioned on and adhered to a surface of the second polymer film, wherein when an opaque material is coated on the top surface of the second polymer film and the first polymer film is adhered to the bottom surface of the second polymer film, the opaque material coating has one or more regions which provide visual access to the underlying first polymer film, and wherein the one or more second security features is also a high value material, wherein the first polymer film is a micro-optic film material and the second polymer film is a film coated with an optically variable material, or wherein the one or more second security features are of a lesser value than the at least one high value material, wherein the second polymer film is a polymer film material having contained therein ultraviolet illuminated pigments or dyes, or infrared absorbing/reflecting materials, wherein the composite security thread comprises:

(a) the first polymer film which is a thin single-layer element in the form of a color shift thread exhibiting a range of colors and having a width that is printed with text or other indicia; and (b) the second polymer film which is a polymer thread having a metal layer on one surface that has been demetalized using a tinted resist to match one of the colors exhibited by the color shift thread, the demetallized metal layer is located between the polymer thread and the tinted resist, the demetalized metal layer and polymer thread having a width larger than the width of the color shift thread, wherein the color shift thread is positioned on and adhered to an opposing surface of the polymer thread.

12. The composite security device of claim 11, wherein a magnetic bar code is incorporated between the color shift thread and the demetalized thread.

13. The composite security device of claim 12, wherein an obscuring layer is applied to a back side of the demetalized thread.

14. The composite security device of claim 11, wherein an obscuring layer is applied to a back side of the demetalized thread.

* * * * *